US008192829B2

(12) United States Patent
Sturley

(10) Patent No.: US 8,192,829 B2
(45) Date of Patent: Jun. 5, 2012

(54) CAST PHOTOLUMINESCENT DEVICES AND PHOTOLUMINESCENT INSERTS FOR SUBSTRATES

(75) Inventor: David K. Sturley, Royal Oak, MI (US)

(73) Assignee: Glow-Mark Technologies, LLC, Royal Oak, MI (US)

( * ) Notice: Subject to any disclaimer, the term of this patent is extended or adjusted under 35 U.S.C. 154(b) by 351 days.

(21) Appl. No.: 12/494,412

(22) Filed: Jun. 30, 2009

(65) Prior Publication Data

US 2009/0262514 A1 Oct. 22, 2009

Related U.S. Application Data

(63) Continuation-in-part of application No. 12/044,286, filed on Mar. 7, 2008, now Pat. No. 7,993,722.

(60) Provisional application No. 60/893,808, filed on Mar. 8, 2007.

(51) Int. Cl.

| | |
|---|---|
| ***B44C 1/26*** | (2006.01) |
| ***B44C 1/28*** | (2006.01) |
| ***B44C 3/12*** | (2006.01) |
| ***B32B 9/00*** | (2006.01) |
| ***B32B 19/00*** | (2006.01) |
| ***B32B 5/16*** | (2006.01) |

(52) U.S. Cl. ..... 428/156; 428/67; 428/323; 428/328; 428/330; 428/690

(58) Field of Classification Search ..... 428/67, 428/323, 690, 328, 330, 917, 156; 52/102, 52/103, 104, 105; 40/542, 543, 544; 250/483.1, 250/462.1

See application file for complete search history.

(56) References Cited

U.S. PATENT DOCUMENTS

| | | | | |
|---|---|---|---|---|
| 3,539,794 | A | 11/1970 | Warren et al. | |
| 4,814,949 | A | 3/1989 | Elliott | |
| 4,998,391 | A * | 3/1991 | Connew | 52/179 |
| 5,315,491 | A | 5/1994 | Spencer et al. | |
| 5,323,492 | A | 6/1994 | DeMars | |
| 5,330,962 | A | 7/1994 | De Braabandere et al. | |
| 5,376,303 | A | 12/1994 | Royce et al. | |
| 5,424,006 | A | 6/1995 | Murayama et al. | |
| 5,811,174 | A | 9/1998 | Murakami | |
| 5,860,724 | A | 1/1999 | Cheng | |
| 5,885,483 | A | 3/1999 | Hao et al. | |
| 5,904,017 | A | 5/1999 | Glatz et al. | |
| 5,944,139 | A | 8/1999 | Kozial | |

(Continued)

FOREIGN PATENT DOCUMENTS

FR 2054877 A 4/1971

(Continued)

OTHER PUBLICATIONS

"Physical Properties of Monomers Table", Polymer Handbook, 4th ed., (1999).

(Continued)

*Primary Examiner* — Catherine A Simone

(57) ABSTRACT

A non-powered path marking system comprises a substrate defining a cavity. A photoluminescent insert comprises a first resinous layer that is cast with photoluminescent particles suspended therein. Adhesive attaches the photoluminescent insert inside of the cavity. A marking device comprises a photoluminescent insert comprising N cast resinous layers, wherein N is an integer greater than or equal to one. A first one of the N cast resinous layers includes photoluminescent particles suspended therein. A fastener includes a first portion cast in the photoluminescent insert and a second portion extending outside of the photoluminescent insert.

21 Claims, 17 Drawing Sheets

U.S. PATENT DOCUMENTS

| | | | | |
|---|---|---|---|---|
| 5,961,072 | A | 10/1999 | Bodle | |
| 5,976,411 | A | 11/1999 | Feng et al. | |
| 6,074,739 | A | 6/2000 | Katagiri | |
| 6,075,250 | A | 6/2000 | Fukui et al. | |
| 6,177,029 | B1 | 1/2001 | Kaz et al. | |
| 6,183,102 | B1 | 2/2001 | Mortz et al. | |
| 6,207,077 | B1 | 3/2001 | Burnell-Jones | |
| 6,375,864 | B1 | 4/2002 | Phillips et al. | |
| 6,599,444 | B2 * | 7/2003 | Burnell-Jones | 252/301.36 |
| 6,617,784 | B1 | 9/2003 | Abe et al. | |
| 6,650,053 | B2 | 11/2003 | Takada et al. | |
| 6,665,986 | B1 | 12/2003 | Kaplan | |
| 6,828,043 | B2 | 12/2004 | Sturley | |
| 7,166,369 | B2 | 1/2007 | Sturley | |
| 7,556,394 | B2 | 7/2009 | Patti | |
| 2004/0137266 | A1 * | 7/2004 | Saito et al. | 428/690 |
| 2005/0102871 | A1 | 5/2005 | Merle et al. | |
| 2005/0160637 | A1 | 7/2005 | Hesse | |
| 2007/0209747 | A1 | 9/2007 | Merle et al. | |

FOREIGN PATENT DOCUMENTS

| | | | |
|---|---|---|---|
| WO | WO 01/42386 | A2 | 6/2001 |

OTHER PUBLICATIONS

Silquest® Silanes Products and Applications Brochure, (2001).

"MSDS—Buehler Castolite and Castoglas Resin" MSDS—Castolite®, (2002), p. 1.

Bodi et al., "Super Phosphorescent Additives for High-Quality Illuminination at Low Additive-Loading Levels". (2000) ANTEC 2000 Plastics: The Magical Solution, vol. 3: Special Areas. Society of Plastics Engineers.

"Liquid Polymer Processing Tips" (2000), Emerson & Cuming Technical Data Sheet.

* cited by examiner

CAST PHOTOLUMINESCENT DEVICES AND PHOTOLUMINESCENT INSERTS FOR SUBSTRATES

CROSS-REFERENCE TO RELATED APPLICATIONS

This application is a continuation-in-part of U.S. patent application Ser. No. 12/044,286, now U.S. Pat. No. 7,993,722 filed on Mar. 7, 2008, which claims the benefit of U.S. Provisional Application No. 60/893,808, filed on Mar. 8, 2007, which are incorporated herein by reference in their entirety.

FIELD

The present disclosure relates to cast photoluminescent devices and inserts.

BACKGROUND

The statements in this section merely provide background information related to the present disclosure and may not constitute prior art.

Referring now to FIGS. 1 and 2, a non-powered photoluminescent paving brick 10 includes a paving brick base 14 that defines a cavity 16. A photoluminescent laminate structure 20 is attached in the cavity 16. The photoluminescent laminate structure is made before attachment in cavity 16. Glue, resin or other adhesive material and/or mechanical fasteners may be used to attach the photoluminescent laminate structure 20 in the cavity 16 of the paving brick base 14. For example, the photoluminescent paving brick 10 can be installed in a walkway to provide light during low light conditions. During daylight hours, the photoluminescent laminate structure 20 absorbs light energy. When the light is removed at dusk, the photoluminescent laminate structure 20 emits light or glows, which provides a non-powered source of light.

In FIG. 2, the photoluminescent laminate structure 20 may include first and second transparent layers 24 and 28 that sandwich an inner photoluminescent layer 26. The transparent layers 24 and 28 typically comprise glass or plastic. The inner layer 26 may comprise a resin layer with photoluminescent or phosphorescent particles suspended therein. The resin that is used typically cures in the absence of air since the resin layer is located between the transparent layers 24 and 28. The resin is typically solvent-based and experiences shrinkage as the solvent is released as a gas. The resin also typically has a relatively high viscosity and low compressive and tensile strength.

One problem associated with the approach shown in FIGS. 1 and 2 includes relatively high material cost for the glass or plastic layers 24 and 28. In addition, the manufacturing cost of the non-powered photoluminescent paving brick is also relatively high. In particular, creating a uniform layer of resin between the transparent layers 24 and 28 can be difficult.

In addition, the durability of the non-powered photoluminescent paving brick 10 may be suspect. There is a tendency for damage to occur when water seeps into gaps between the paving brick base 14 and the photoluminescent laminate structure 20. Since the paving brick 10 is typically installed outdoors, the paving brick 10 is subject to wide temperature variation and standing water. When the water freezes and thaws, it expands and contracts and the laminate structure 20 experiences relatively high pressure. In addition, the photoluminescent laminate structure 20 may experience delamination when soaked in water—even in the absence of freezing temperatures. As a result, the photoluminescent laminate structure 20 may tend to delaminate, break or separate from the paving brick base 14.

Furthermore, when an outer surface of the transparent layer 28 of the photoluminescent laminate structure 20 becomes wet, a coefficient of friction of the outer surface may be reduced. Since the paving brick 10 may often provide a walking surface, the non-powered photoluminescent paving brick 10 may be relatively slippery.

SUMMARY

A path marking system comprises a substrate defining a cavity. A photoluminescent insert comprises a first resinous layer that is cast with photoluminescent particles suspended therein. Adhesive attaches the photoluminescent insert inside of the cavity.

In other features, the photoluminescent insert further comprises a second resinous layer that is cast adjacent to and in contact with a first surface of the first resinous layer. A third resinous layer is cast adjacent to and in contact with a second surface of the first resinous layer. The second resinous layer comprises a reflection-enhancing material. The second resinous layer comprises titanium dioxide. The photoluminescent particles comprise a phosphorescent material based on Strontium Oxide Aluminate chemistry. The photoluminescent particles comprise at least one dimension that is at least one of greater than or equal to 250 microns; greater than or equal to 500 microns; greater than or equal to 700 microns; and greater than or equal to 900 microns.

In other features, the phosphorescent insert forms a gap between an outer edge thereof and the cavity. Fill material is arranged in the gap. The first resinous layer comprises transparent beads. The first resinous layer is cast in an annular ring and is bonded to the annular ring. The resinous layer is cast with an annular strip in a mold with first and second ends of the annular strip in an abutting relationship. A coating is applied to at least one of sides of the first resinous layer and an outer surface of the first resinous layer. The photoluminescent insert comprises a member including side walls and a bottom surface that define a cavity. The first resinous layer is cast in the member.

A marking device comprises a photoluminescent insert including N cast resinous layers, wherein N is an integer greater than or equal to one. A first one of the N cast resinous layers includes photoluminescent particles suspended therein. A fastener includes a first portion cast in the photoluminescent insert and a second portion extending outside of the photoluminescent insert.

In other features, a second one of the N cast resinous layers is cast adjacent to and in contact with a first surface of the first one of the N cast resinous layers. A third one of the N cast resinous layers is cast adjacent to and in contact with a second surface of the first one of the N cast resinous layers. The second one of the N cast resinous layers comprises a reflection-enhancing material. The second one of the N cast resinous layers comprises titanium dioxide.

In other features, the photoluminescent particles comprise a phosphorescent material based on Strontium Oxide Aluminate chemistry. The photoluminescent particles comprise at least one dimension that is at least one of greater than or equal to 250 microns; greater than or equal to 500 microns; greater than or equal to 700 microns; and greater than or equal to 900 microns.

In other features, the first one of the N cast resinous layers comprises transparent beads. The first one of the N cast resinous layers is cast inside an annular ring and bonds to the annular ring. The first one of the N cast resinous layers is cast with an annular strip in a mold with first and second ends of the annular strip in an abutting relationship.

In other features, a coating is applied to at least one of sides of the first one of the N cast resinous layers and an outer surface of the first one of the N cast resinous layers. The photoluminescent insert comprises a member including side walls and a bottom surface that define a cavity. The first one of the N cast resinous layers is cast in the cavity of the member.

Further areas of applicability will become apparent from the description provided herein. It should be understood that the description and specific examples are intended for purposes of illustration only and are not intended to limit the scope of the present disclosure.

DRAWINGS

The drawings described herein are for illustration purposes only and are not intended to limit the scope of the present disclosure in any way.

DETAILED DESCRIPTION

The following description is merely exemplary in nature and is not intended to limit the present disclosure, application, or uses. Unless otherwise stated herein, it is understood that features described with respect to one embodiment or FIG. may be used in any other FIG. or embodiment described herein.

Figure 1:
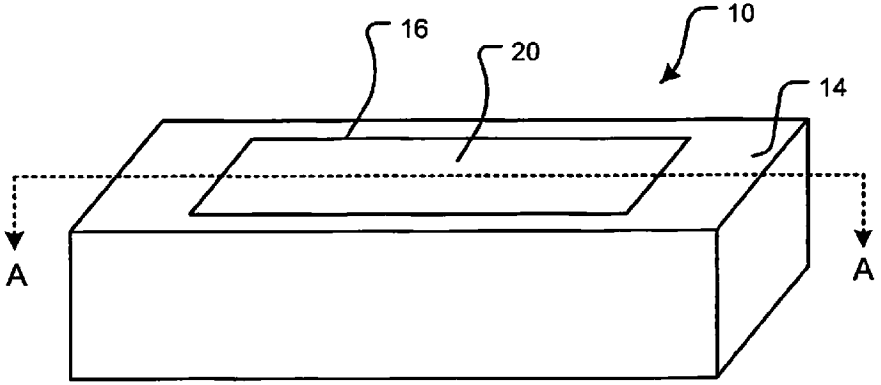
FIG. 1 Prior Art
FIG. 1 is a perspective view of a non-powered photoluminescent paving brick according to the prior art.
Figure 2:
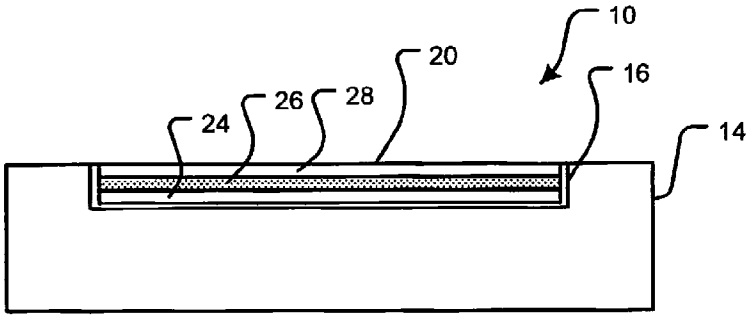
FIG. 2 Prior Art
FIG. 2 is a cross-sectional view of the photoluminescent paving brick of FIG. 1.
Figure 3B:
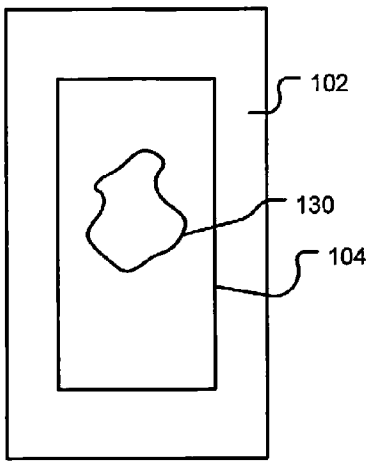
FIG. 3B is a plan view illustrating a first cavity and an optional second cavity.
Figure 3A:
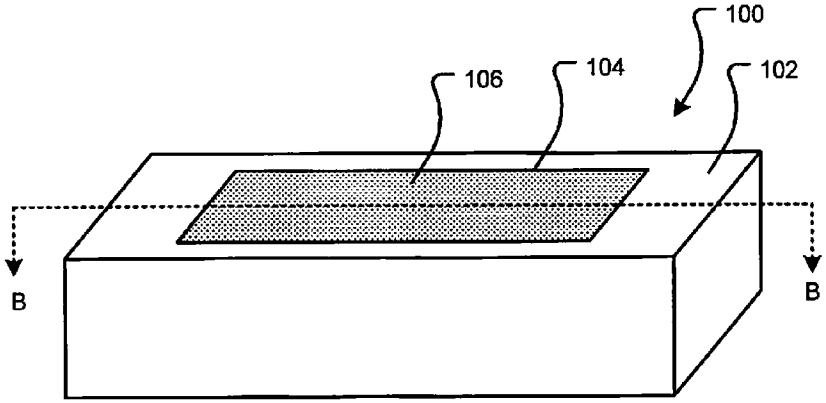
FIG. 3A is a perspective view of a non-powered photoluminescent device according to the present disclosure.
Figure 4:
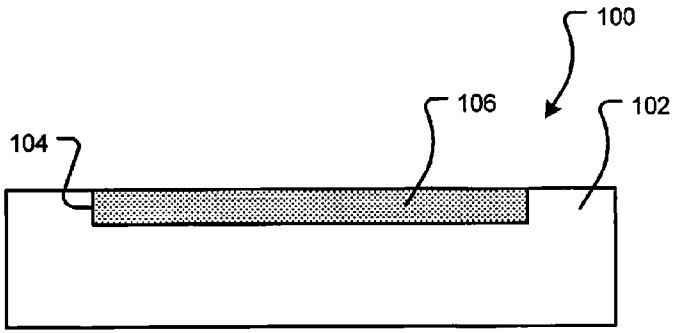
FIG. 4 is a cross-sectional view of the photoluminescent device of FIG. 3A.

Referring now to FIGS. 3A, 3B and 4, a non-powered photoluminescent device 100 according to the present disclosure is shown. While the present disclosure will describe exemplary paving bricks, the techniques described herein may be applied to any suitable substrate with a cavity or channel. For example, the substrate may include cement, asphalt, tile, other floor materials, decorative molding or other substrates.

The non-powered photoluminescent device 100 includes a paving brick or other substrate 102 defining a cavity 104. The cavity 104 may be formed during manufacturing or cut after manufacturing. While a rectangular cavity is shown, the cavity 104 may have any suitable shape. The cavity 104 may have a shape in the form of letters, logos, or other suitable shapes. Two or more adjacent paving bricks may have different-shaped cavities that together form a shape. For example only, multiple paving bricks may show a direction of a walking path.

A photoluminescent resin layer 106 may be cast, molded or formed in the cavity 104. Alternatively, the photoluminescent resin layer 106 may be cast, molded or formed and then later installed in the cavity 104. The same resin may be used to attach the layer 106 in the cavity 104. The photoluminescent resin layer 106 includes a transparent resin material with photoluminescent or photoluminescent particles suspended therein, as will be described further below.

In FIG. 3B, the cavity 104 may optionally include a second cavity 130 having a regular or irregular shape. The second cavity 130 may be smaller than the cavity 104. The second cavity 130 is shown with an irregular shape. Examples of regular shapes include squares, circles, polygons, and/or other symmetric shapes. The second cavity 130 provides additional surface area to which the resin may attach inside the cavities 104 and 130. As a result, durability may be improved. The second cavity 130 may also be used as a watermark to differentiate genuine paving bricks from knock-off paving bricks.

In some implementations, the resin may include a two-part resin. The resin may be a solvent-free resin that experiences negligible shrinkage during curing. The resin may experience negligible evaporation during curing. The resin may experience less than 0.1% shrinkage. More particularly, the resin may experience less than 0.01% shrinkage. For example only, the resin may be Crystal Clear™ resin available from Smooth-On located in Pennsylvania, United States. Crystal Clear™ 202 resin may be used, although other resins are contemplated.

The resin may have a high tensile strength after curing. The resin may have tensile and compressive strengths greater than about 1000 psi. The resin may have a tensile and compressive strength greater than 2000 psi. Crystal Clear™ 202 has a tensile strength of 2800 psi, a compressive strength of 2208 psi and a shrinkage factor or approximately 0.0013 inches per inch. The resin may be clear and UV resistant.

The resin may have a relatively low viscosity to allow the resin to seep into pores of the paving brick or substrate to ensure that the photoluminescent resin layer 106 attaches securely to a surface of the cavity 104. In other words, high viscosity material may not seep into the pores of the substrate and adequately bond therewith, which may result in delamination. For example, Crystal Clear™ 202 has a viscosity of approximately 600 centipoise (cps) at 72° F. The resin may have a viscosity that is less than 1500 cps at 72° F. The resin may have a viscosity that is less than 1000 cps at 72° F. The resin may have a viscosity that is about 600 cps at 72° F. plus or minus 100 cps.

When multiple layers of the resin are used and fully or partially cured, the resin may form relatively seamless bonds between the layers. In other words, the multiple layers bond together and form a relatively seamless unitary structure that does not have compromised strength. Furthermore, the resin does not experience delamination of the multiple layers after curing. The bonds may also be optically clear after curing.

In some implementations, the photoluminescent resin layer 106 may have a thickness between ⅛" and ½", although other thicknesses may be used. In some implementations, the resin layer 106 may include between 3 grams (g) and 200 g of photoluminescent particles per ⅛" resin layer per 10 $in^2$. In some implementations, the resin layer 206 may include between 5-100 g of photoluminescent particles per ⅛" layer per 10 $in^2$. Other ranges such as 5-30 g or 5-15 g may be used. The photoluminescent particles may have a size between 2 and 200 microns. More particularly, the photoluminescent particles may have a size of about 70 microns. Other photoluminescent particles may a size of 200 microns.

Suitable photoluminescent particles include long decay phosphors described in U.S. Pat. No. 5,376,303, long afterglow phosphors of U.S. Pat. No. 5,885,483 and photostorage and emissive materials of U.S. Pat. No. 6,177,029, which are all hereby incorporated by reference in their entirety.

The long decay phosphor of U.S. Pat. No. 5,376,303 is comprised of $MO.a(A1_{1-b}B_b)_2O_3:cR$ herein:

$0.5 \leqq a \leqq 10.0$, $0.0001 \leqq b \leqq 0.5$ and $0.0001. \leqq c \leqq 0.2$, MO represents at least one divalent metal oxide selected from the group consisting of MgO, CaO, SrO and ZnO and R represents Eu and at least one additional rare earth element selected from the group consisting of Pt, Nd, Dy and Tm.

In U.S. Pat. No. 5,885,483, the long afterglow phosphors comprise a sinter expressed by a general formula $MO.(n-x)\{a A1_2O_3 a^*(1-a)A1_2O_3^{\gamma}\}B_2O_3:R$ wherein M represents an alkaline earth metal, T represents a rare earth element, $0.5<a \leqq 0.99$, $0.001 \leqq x \leqq 0.35$, $1 \leqq n \leqq 8$ and a part of M may be replaced with at least one alkaline earth metal selected from the group consisting of Mg, Ca and Ba.

The photostorage and emissive material of U.S. Pat. No. 6,177,029 is composed of photoluminescent material that absorbs light from a light source such as UV light. The photoluminescent material re-emits the light energy in a first wavelength spectrum when the light source is removed. A second material is mixed with the photoluminescent material. The second material is selected from the group consisting of fluorescent colorants and optical brighteners that absorb light at the first wavelength spectrum and re-emit the absorbed light at a second wavelength spectrum. The photoluminescent particles described herein may absorb light at ultraviolet wavelengths and re-emit light at visible wavelengths.

In use, the non-powered photoluminescent device 100 absorbs ultraviolet light energy into the photoluminescent particles, which store the energy until a source of light is removed. For outdoor applications, the source of light may be removed when the sun goes down. For other applications, the source of light may be removed when a powered source of light is turned off (for example intentionally, due to power failure or other emergency). When the source of light is removed, the particles emit light energy in the visible spectrum.

The photoluminescent particles can be the photoluminescent particles described above and in the concentrations described above (hereinafter high light (HL) photoluminescent particles). The photoluminescent particles are called HL due to their ability to be charged outdoors by UV light with only ordinary degradation of the photoluminescent particles. The photoluminescent particles may be charged on cloudy days since UV light will be present—unlike some solar powered devices.

In other embodiments, low light (LL) photoluminescent particles are used alone or in combination with the HL photoluminescent particles. The LL photoluminescent particles have a shorter charge time and require lower levels of UV light to charge. The LL photoluminescent particles charge with indoor sources of light but experience accelerated degradation if charged with higher intensity outdoor light. The LL photoluminescent particles may be suitable for indoor applications.

The LL photoluminescent particles may include GLL300M available under the trademark Luminova® from United Mineral and Chemical Corp. of Lyndhurst, NJ and Nemota & Co. LTD. of Tokyo, Japan. The HL photoluminescent particles may include G300, BG300 or V300 available under the trademark Luminova® from United Mineral and Chemical Corp. and Nemota & Co. LTD. of Tokyo, Japan. As can be appreciated, the photoluminescent resin layers described above can also be implemented using LL, HL and/or LL and HL photoluminescent particles. LL photoluminescent particles may be suitable for indoor applications such as indoor pavers, tile, molding, trim, swimming pool steps, risers and the like.

Figure 5A:
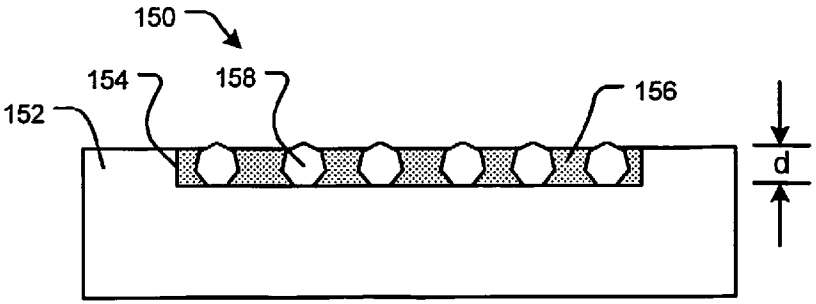
FIGS. 5A and 5B are cross-sectional views illustrating friction-enhancing particles suspended in a resin layer.
Figure 5B:
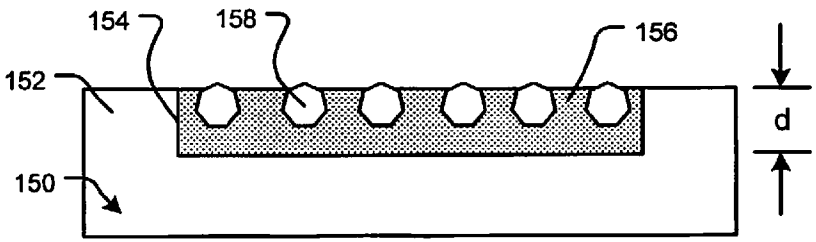

Referring now to FIGS. 5A and 5B, friction-enhancing particles can be added to the resin layer that includes the photoluminescent particles. In FIG. 5A, a photoluminescent device 150 includes a cavity 154 and a photoluminescent resin layer 156. Friction-enhancing particles 158 may be added to the photoluminescent resin layer 156.

The friction-enhancing particles 158 may have an outer dimension that is greater than a thickness "d" of the photoluminescent layer 156 such that at least part of the frictional particles project outwardly from an outer surface of the photoluminescent layer 156. The thickness "d" may be greater than or equal to 1/16" and less than or equal to 1/2". The thickness "d" may be about 1/8". Still other thicknesses are contemplated.

The friction-enhancing particles 158 may be transparent or clear to allow light to pass through. In some implementations, the friction-enhancing particles 158 may include Aluminum Oxide ($AlO_2$) particles, Silica particles, and/or Quartz particles, although other materials may be used. The friction-enhancing particles 158 may be mixed with the resin and the photoluminescent particles and then poured into the cavity 154. Alternately the friction-enhancing particles may be added to a mixture of the resin and photoluminescent particles after the mixture has been poured into the cavity 154. The friction-enhancing particles may have any suitable shape.

In FIG. 5B, the friction-enhancing particles 158 have an outer dimension that is less than a thickness "d" of the photoluminescent layer 156. There are several ways to implement the embodiment in FIG. 5B. For example only, the photoluminescent particles 158 can be added after the resin in the photoluminescent portion has been poured into the cavity and has at least partially cured. The increased viscosity due to partial curing may allow the friction-enhancing particles to float above the outer surface while being part of the resin layer. Alternately, the friction-enhancing particles can be selected to have a density that is less than the density of the resin in the photoluminescent layer 156. These lower-density friction-enhancing particles can be added to the mixture before or after pouring. Since the density is lower, they will tend to float at least partially above the outer surface. Still other variations are contemplated. The friction-enhancing particles may be glued to an outer surface after the outer layer has cured.

Figure 6:
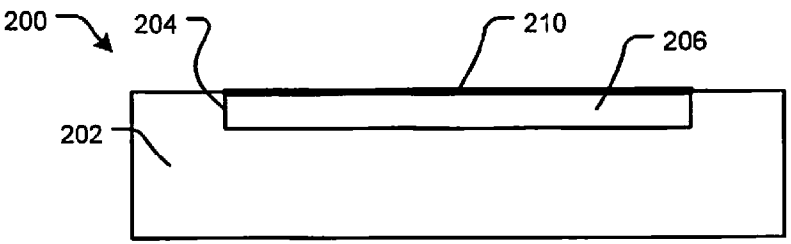
FIG. 6 is a cross-sectional view illustrating an outer surface having a higher coefficient of friction due to sanding or another abrasive method.

Referring now to FIG. 6, a photoluminescent device 200 includes a cavity 204 formed in a paving brick or other substrate 202 and a photoluminescent resin layer 206 in the cavity 204. An abrasive material such as sanding paper or a grinding wheel may be used to scuff an outer surface 210 of the photoluminescent layer 206 to increase a coefficient of friction of the outer surface 210. The photoluminescent resin layer 206 may have a thickness greater than or equal to 1/16" and less than or equal to 1/2". The photoluminescent resin layer 206 may have a thickness of approximately 1/8". Still other thicknesses are contemplated.

Figure 7B:
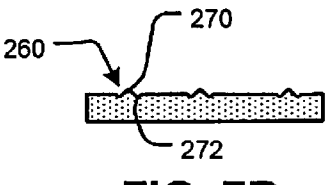
FIG. 7B is a cross-sectional view the embossed or grooved outer surface of the resin layer of FIG. 7A.
Figure 7A:
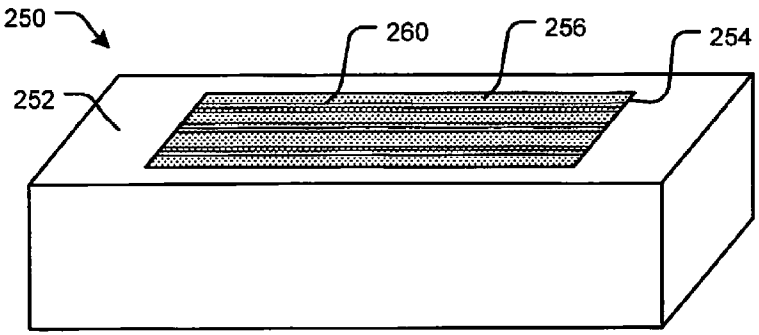
FIG. 7A is a perspective view of an alternate photoluminescent device with an embossed or grooved outward facing surface.

Referring now to FIGS. 7A and 7B, an alternate photoluminescent device 250 with an embossed or grooved outer surface is shown. In FIG. 7A, a photoluminescent device 250 includes a cavity 254 formed in a paving brick or other substrate 252 and a photoluminescent resin layer 256 in the cavity 254. After the photoluminescent portion is at least partially cured, an outer surface thereof is scored or embossed at 260 to create raised portions 270 and/or lowered portions 272 as can be seen in FIG. 7B. The raised and/or lowered portions 270 and 272, respectively, tend to increase a coefficient of friction of the outer surface. The photoluminescent resin layer 256 may have a thickness greater than or equal to 1/16" and less than or equal to 1/2". The photoluminescent resin layer 256 may have a thickness of approximately 1/8". Still other thicknesses are contemplated.

Figure 8:
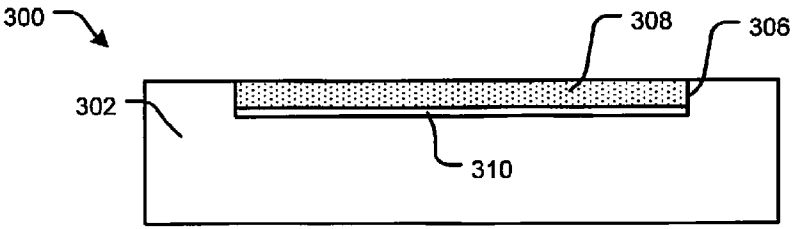
FIG. 8 is a side cross-sectional view of a reflective layer and a resin layer with suspended photoluminescent particles.

Referring now to FIG. 8, a photoluminescent device 300 includes a cavity 304. A photoluminescent resin layer 306 is arranged over a reflective layer 310 in the cavity 304. The reflective layer 310 may comprise any material that increases reflectivity of light incident thereon. The reflective layer 310 may include a paint layer applied to a surface of the paving brick. Alternately, the reflective layer 310 may include a layer of resin mixed with a light pigment such as a white, silver or other light colored pigment. Alternately, the reflective layer 310 may include a zinc metallic powder that is mixed with a resin layer. Other reflective layers may include a light colored fabric that is resin-permeable so that the resin may seep through the fabric and attach itself along a bottom surface of the cavity.

If the layer of resin mixed with pigment or zinc metallic powder is used, the layer may have a thickness greater than or equal to 1/16" and less than or equal to 1/2". The layer of resin may have a thickness of approximately 1/8". The photoluminescent resin layer 306 may have a thickness greater than or equal to 1/16" and less than or equal to 1/2". The photoluminescent resin layer 306 may have a thickness of approximately 1/8". Still other thicknesses are contemplated.

Figure 9:
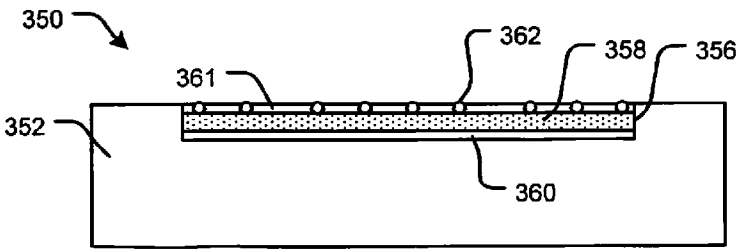
FIG. 9 is a side cross-sectional view of a reflective layer, a resin layer with suspended photoluminescent particles and a layer with friction-enhancing particles.

Referring now to FIG. 9, a photoluminescent device 350 includes a cavity 354 formed in a paving brick or other substrate 352. A reflective layer 360 is arranged in the cavity 354. A photoluminescent layer 358 is arranged above the reflective layer 360. A resin layer 361 is added and includes friction-enhancing particles 362. The friction-enhancing particles 362 may have an outer dimension that is greater than a thickness of the outer resin layer 361. As a result, at least part of the friction-enhancing particles project outwardly from an outer surface of the photoluminescent layer 361. Alternately, the friction-enhancing particles may be implemented as shown in FIG. 5B.

The reflective layer 360, the photoluminescent layer 358 and the resin layer 361 may have a combined thickness greater than 3/16" and less than 1/2". The lower reflective layer 360, the middle photoluminescent layer 358 and the outer resin layer 361 may each have a thickness of approximately 1/8". Still other thicknesses are contemplated.

Referring now to FIG. 10-14, various exemplary methods for making the photoluminescent device according to the present disclosure are shown.

Figure 10:
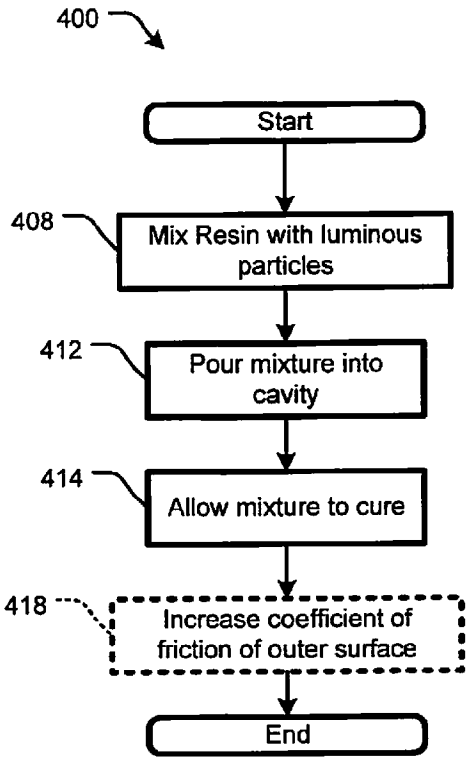

In FIG. 10, a first method 400 for making a non-powered photoluminescent substrate is shown. In step 408, resin is mixed with photoluminescent particles. In step 412, the mixture is poured into a cavity in a substrate. In step 414, the mixture is allowed to cure. In step 418, a coefficient of friction of an outer surface of the photoluminescent portion may be optionally increased using any of the methods described above.

Figure 11:
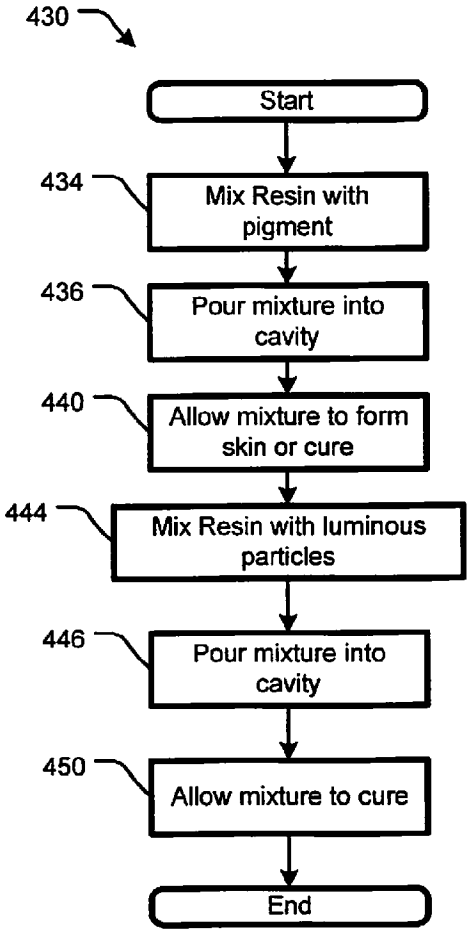
FIGS. 10-14 illustrate various exemplary methods for making the non-powered photoluminescent paving brick according to the present disclosure.

In FIG. 11, another method 430 for making a non-powered photoluminescent substrate is shown. In step 434, resin is mixed with pigment or zinc metallic powder. In step 436, the mixture is poured into a cavity in a substrate. In step 440, the mixture is allowed to cure or an outer skin is formed. An outer skin forms before curing occurs. In step 444, resin is mixed with photoluminescent particles. In step 446, the mixture is poured into the cavity. In step 450, the mixture is allowed to cure.

Figure 12:
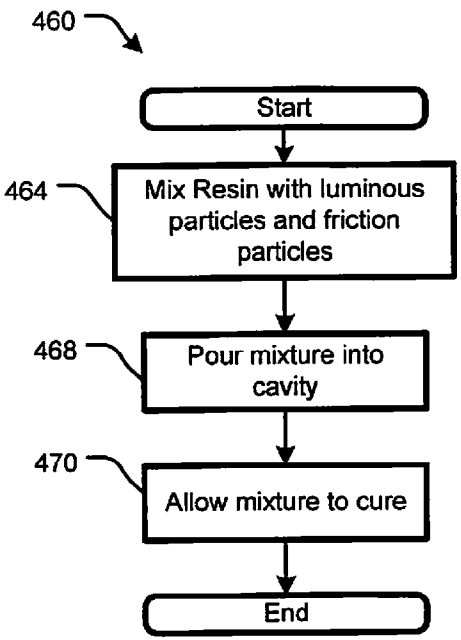

In FIG. 12, another method 460 for making a non-powered photoluminescent substrate is shown. In step 464, resin is mixed with photoluminescent particles and friction-enhancing particles. In step 468, the mixture is poured into a cavity. In step 470, the mixture is allowed to cure.

Figure 13:
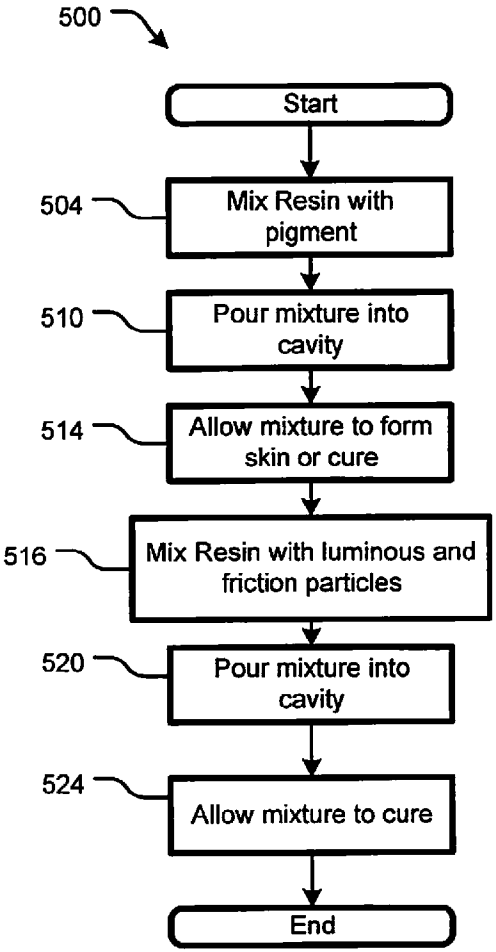

In FIG. 13, another method 500 for making a non-powered photoluminescent substrate is shown. In step 504, resin is mixed with a pigment. The mixture is poured into a cavity of a substrate in step 510. In step 514, the mixture is allowed to cure or form a skin. In step 516, the resin is mixed with photoluminescent particles and friction-enhancing particles. In step 520, the mixture is poured into the cavity of the substrate. In step 524, the mixture is allowed to cure.

Figure 14:
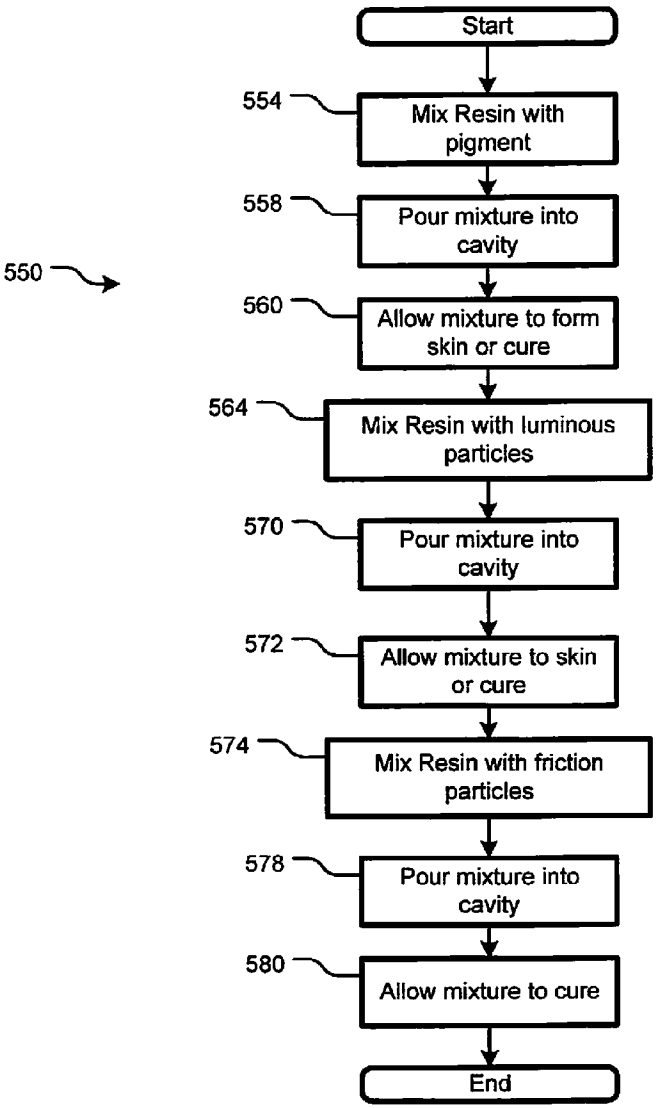

In FIG. 14, another method 550 for making a non-powered photoluminescent substrate is shown. In step 554, resin is mixed with pigment or zinc metallic powder as described above. In step 558, the mixture is poured into a cavity of a substrate. In step 560, the mixture is allowed to cure or form a skin. In step 564, the resin is mixed with photoluminescent particles. In step 570, the mixture is poured into the cavity of the substrate. In step 572, the mixture is allowed to cure and/or form a skin. In step 574, the resin is mixed with friction-enhancing particles. In step 578, the mixture is poured into a cavity. In step 580, the mixture allowed to cure.

In any of the foregoing embodiments, curing may be performed by allowing air drying. Alternately, curing may be accelerated using heat. In addition, cure enhancing additives may be added to the resin mixture.

Advantages of the foregoing include reduced manufacturing cost as compared to other approaches. In addition, the structure is more durable and resistant to the adverse effects of weather. Furthermore, the transparent layers are eliminated. These structures may reduce light incident upon the photoluminescent particles and may also reduce the intensity of the glow.

While the photoluminescent portion can be cast, molded or formed in the cavity or channel, the photoluminescent portion can be formed, cast or molded outside of the cavity or channel and then installed in the cavity or channel using an adhesive. For example only, the resin used for the photoluminescent portion can be used as an adhesive to attach the photoluminescent portion in the cavity or channel and to create a seamless bond.

Figure 15:
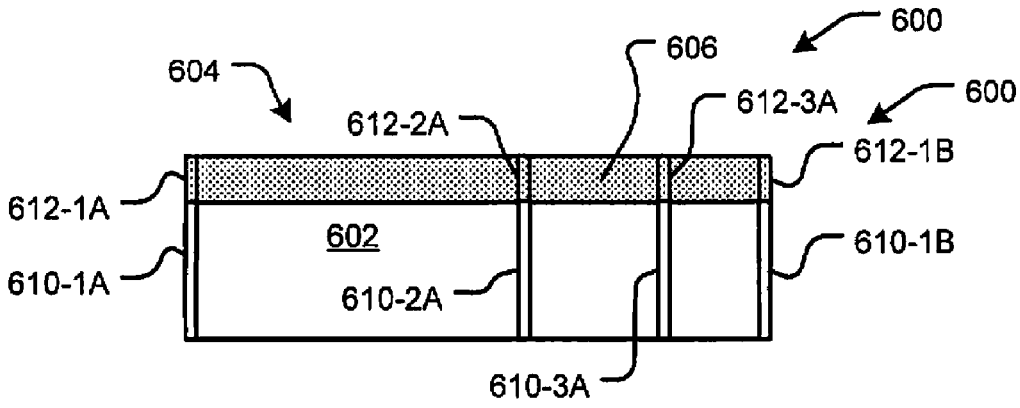
FIG. 15 illustrates another exemplary photoluminescent device.
Figure 16:
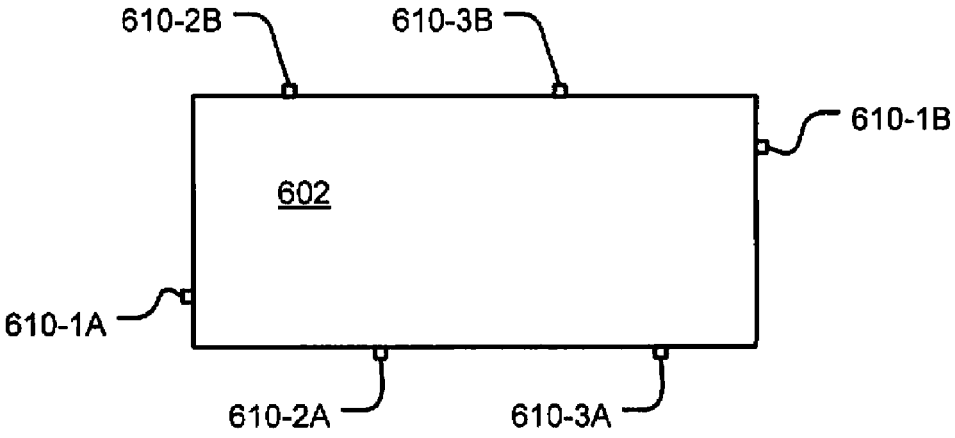
FIG. 16 illustrates a substrate of FIG. 15 in further detail.

Referring now to FIGS. 15 and 16, another exemplary photoluminescent paving brick or other device 600 comprises a substrate 602 and a photoluminescent portion 604. The substrate 602 can be made of high strength plastic that can be molded, cast or injected. The photoluminescent portion 604 may be formed as described above and may include any of the features described above. The plastic may include a material selected from a group consisting of Polypropylene, Nylon, Nylon 6, Nylon 6-6, Polybutylene Terepthalate (PBT) Polyester, Acrylic or other high tensile strength plastic. The plastic may have a high tensile strength sufficient to allow sidewalk or driveway traffic. The plastic may have a tensile strength greater than or equal to approximately 2000-3000 psi for light traffic. For heavy traffic, the plastic may have a tensile strength greater than approximately 7000-8000 psi. For pressures, the term approximately shall mean +/−500 psi. As can be appreciated, the lighter weight of the plastic substrate brick will make the bricks easier to ship.

The substrate 602 may have a generally rectangular shape, a circular shape, a square shape, a symmetric shape, a polygon shape and/or any other suitable shape. Raised portions 610-1A, 610-1B, 610-2A, 610-2B, 610-3A, and 610-3B (collectively raised portions 610) may be formed along sides of the substrate 602. Corresponding raised portions 612-1A, 612-1B, 612-2A, 612-2B, 612-3A, and 612-3B (collectively raised portions 612) may be formed along sides of the photoluminescent portion 604.

The raised portions 610 may align with corresponding ones of the raised portions 612. The raised portions 610 and 612 are offset such that they do not abut corresponding raised portions 610 and 612 on an adjacent paving brick when installed. As a result, sand, dirt or other filler material may be easily inserted between the abutting paver bricks to limit movement of the paver bricks.

Figure 17:
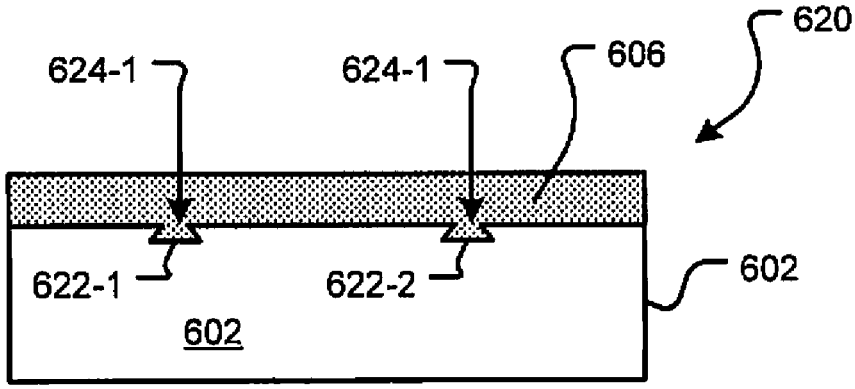
FIG. 17 illustrates an alternative substrate with anchoring cavities.

Referring now to FIG. 17, an alternative substrate with anchoring portions between the photoluminescent portion and the substrate is shown. The substrate 602 defines one or more anchoring cavities 622 (anchoring cavities 622-1 and 622-2 are shown) that allow part of the photoluminescent portion 604 to enter during manufacturing (casting or molding).

When the material dries, the photoluminescent portion 604 is securely held to the substrate 602. This structure greatly enhances strength—which may be helpful when the paving brick is subjected to changing temperatures and moisture. For example, the part of the photoluminescent portion 604 that enters the anchoring cavities 622 may include the resin alone, a mixture of the resin and photoluminescent particles (and/or other materials). As a result, the photoluminescent portion 604 forms one or more anchoring portions 624 (anchoring portions 624-1 and 624-2 are shown) that are secured in the anchoring cavities 622-1 and 622-2.

Figure 18:
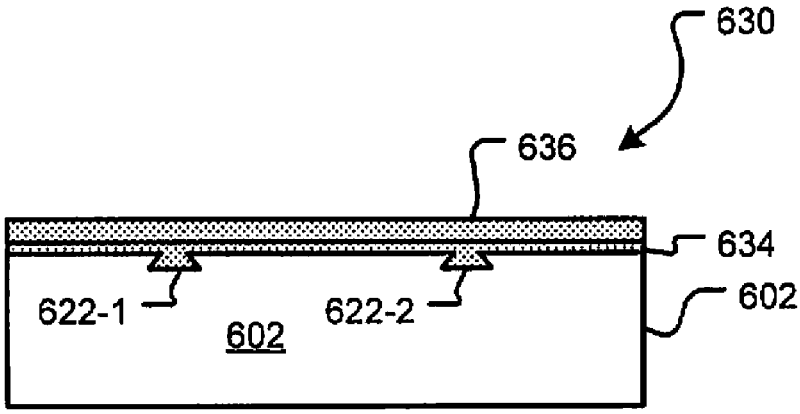
FIG. 18 illustrates a multi-layer photoluminescent portion.

Referring now to FIG. 18, two or more layers can be used to form the photoluminescent portion 604. A first layer 634 may be applied in the cavity and in the anchoring cavities 622-1 and 622-2. After full or partial curing, a second layer 636 may be applied on top of the first layer 634.

The first layer 634 may comprise resin, resin and pigment (such as white pigment), resin and photoluminescent particles, or resin and any other material. The second layer 636 may comprise resin and photoluminescent particles. When a single layer is applied as in FIG. 17, the photoluminescent particles may tend to fall to a lowest point due to their heavier specific gravity. As a result, the photoluminescent particles may end up concentrating in the anchoring cavities 622-1 and 622-2, which can be seen when viewing the paving brick from the top. Furthermore, some of the resins described herein are relatively optically clear after curing and do not tend to show boundaries between cured layers. Therefore, when two or more layers are used and first layer does not include photoluminescent material, the anchoring cavities are less visible from the top of the paving brick.

As can be appreciated, the anchoring cavities 622 may be made parallel to each other. Alternately, additional anchoring portions may be used and may be arranged at different angles to increase strength.

In some implementations, the substrate is formed of plastic using any suitable process. For example, thermoforming, injection molding, CNC machining or any other suitable approach may be used. Additionally, post forming steps such as CNC milling can be used to trim edges and/or to form anchoring cavities. Alternately, these anchoring structures can be formed during manufacturing.

Figure 19:
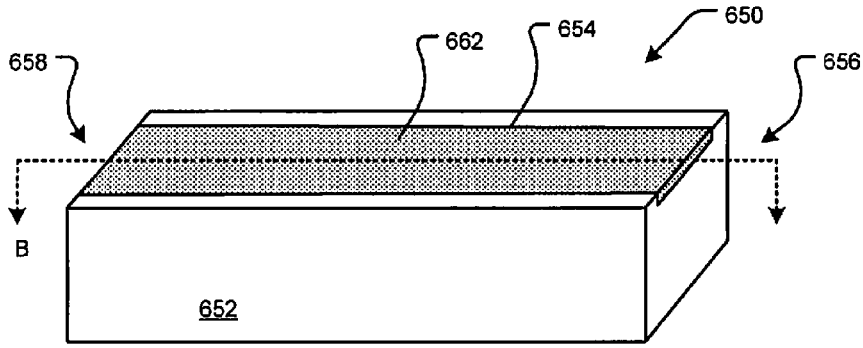
FIG. 19 illustrates another exemplary photoluminescent paving brick or other a substrate with a channel formed from one end to an opposite end thereof and photoluminescent portion in the cavity.

Referring now to FIG. 19, another exemplary photoluminescent paving brick 650 includes a substrate 652. The substrate 652 may be a conventional paving brick. A channel 654 is created from one end 656 to an opposite end 658 of the substrate 652. The channel can be created during manufacturing of the paving brick or cut after the paving brick is manufactured.

A photoluminescent portion 662 is molded, cast or formed in the channel or pre-formed, molded or cast and adhered in the channel with adhesive as described above. The photoluminescent portion 662 may comprise one or more layers as described herein.

As can be appreciated, the cavities described above may be formed in the paving brick during manufacturing of the paving brick. Alternately, the cavities described herein can be routed or drilled in the paving brick after manufacturing the paving brick. A more simple approach may be to use the channel 654. For example, the channel 654 may be created using a router bit that cuts from one end to the other rather than a plunge cutting method used to form a central cavity. The plunge cutting methods may tend to be more time consuming and expensive.

Figure 20:
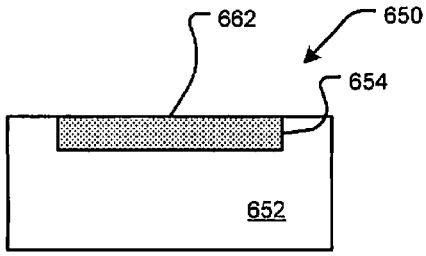
FIG. 20 is an end view of the exemplary photoluminescent device of FIG. 19.
Figure 21:
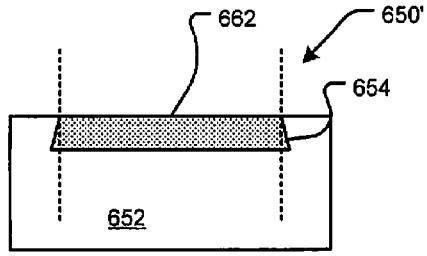
FIG. 21 is an alternate end view of the exemplary photoluminescent device of FIG. 19.

Referring now to FIGS. 20 and 21, exemplary end views of the exemplary photoluminescent paving brick of FIG. 19 are shown. The channel can have a rectangular or square end view. Alternately, the channel can have a trapezoidal cross section or other cross section with an undercut region to more securely hold the photoluminescent portion therein.

Figure 22:
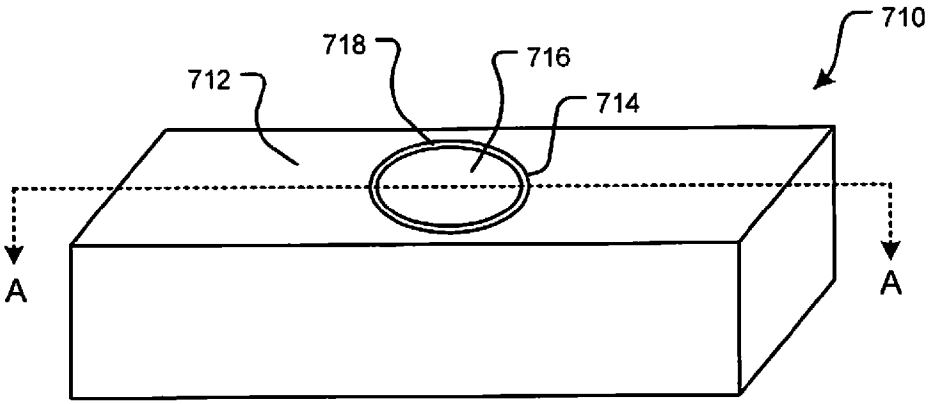
FIG. 22 is a perspective view of a non-powered photoluminescent substrate including a cavity with a photoluminescent insert according to another embodiment.

Referring now to FIG. 22, a perspective view of a substrate 710 including a non-powered photoluminescent insert is shown. The substrate 710 includes at least one surface 712 including a cavity 714. A photoluminescent insert 716 is attached to the substrate 710 in the cavity 714 using an adhesive (not shown). The photoluminescent insert 716 may comprise one or more cast layers. In some implementations, the photoluminescent insert 716 may define a gap 718 between the cavity 714 and a radially outer edge of the photoluminescent insert 716. The gap 718 provides relief to accommodate different rates of expansion and contraction of the substrate relative to the photoluminescent insert 716.

Figure 23:
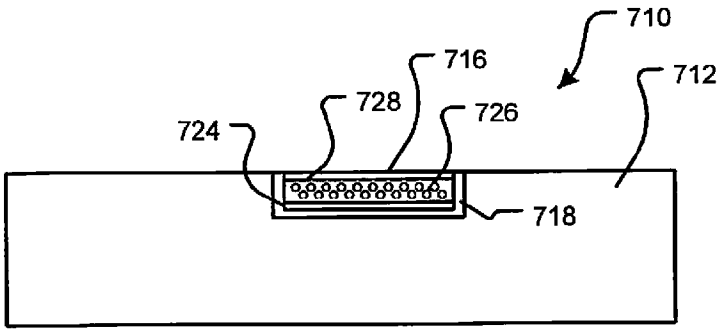
FIG. 23 is a cross-sectional view of the photoluminescent paving brick and the photoluminescent insert of FIG. 22.

Referring now to FIG. 23, a cross-sectional view of the substrate 710 and the photoluminescent insert 716 of FIG. 22 is shown. The photoluminescent insert 716 may include a first cast layer 724, a second cast layer 726 and a third cast layer 728. The first cast layer 724 may include a resinous material including a pigment, a reflective material, and/or a material having a relatively high index of refraction added thereto. For example only, the first cast layer may comprise a white pigment, titanium dioxide or other material. The second cast layer 726 may include a resinous material with photoluminescent particles mixed therein. The third cast layer 728 may comprise the resinous material.

For example only, the substrate may comprise a brick, paving brick, a concrete substrate, asphalt, wood and/or any other suitable substrate. A drill press and drill bit may be used to create the cavity in the substrate in situ and/or prior to installation of the substrate. Alternately, the cavity may be formed in the substrate during its manufacture. The resin may comprise any suitable resin. In some implementations, the resin may comprise a transparent urethane casting resin such as one or more of the resins described above.

In some implementations, the photoluminescent particles include phosphorescent material based on Strontium Oxide Aluminate chemistry. In some implementations, the photoluminescent particles comprise the photoluminescent particles described above. In addition to the particle dimensions described above, the photoluminescent particles may comprise at least one dimension that is at least one of greater than or equal to 250 microns, greater than or equal to 500 microns, greater than or equal to 700 microns, and/or greater than or equal to 900 microns. In other implementations, the photoluminescent particles have at least one dimension in the range of 700 to 5000 microns.

In some implementations, the adhesive may be suitable for bonding different types of materials such as plastic to masonry. In some implementations, the adhesive may comprise a single component polyurethane elastomeric sealant. The adhesive may cure under the effect of atmospheric humidity to form a flexible and resilient joint. In some implementations, the adhesive may comprise 3M™ Polyurethane Construction Sealant # 525, #540 or a similar adhesive. The adhesive may have a relatively high elongation factor (greater than 300%) to accommodate different coefficients of thermal expansion. For example, the elongation factor of the 3M™ Polyurethane Construction Sealant # 525 or #540 may be over 600%.

In addition to the photoluminescent inserts that are described above and that are attached inside of the cavity of the substrate, a similar approach may be used to create photoluminescent devices that are not attached inside a cavity of a substrate. For example only, the photoluminescent devices may comprise adhesive or other attachment mechanism that is used to attach it to a non-cavity-like surface or an approximately planar surface of an object. For example only, pressure sensitive adhesive may be used to attach the phosphorescent devices to an outer surface of a paving brick.

In some implementations, light incident upon the photoluminescent insert initially passes through a cast resinous layer rather than through glass or plastic layers as in some conventional devices.

In some implementations, the photoluminescent insert has a diameter of 1½" to 2" and a thickness of approximately ½", although other dimensions may be used. The first cast layer 724 comprises titanium dioxide mixed with about 5-6 cc of a two-part urethane casting resin. The second cast layer 726 comprises 5-6 grams of phosphorescent particles (having at least one dimension between 700 and 1000 microns) mixed with 5-6 cc of the two-part urethane casting resin. The third cast layer 728 comprises 2 cc of the two-part urethane casting resin.

Figure 24:
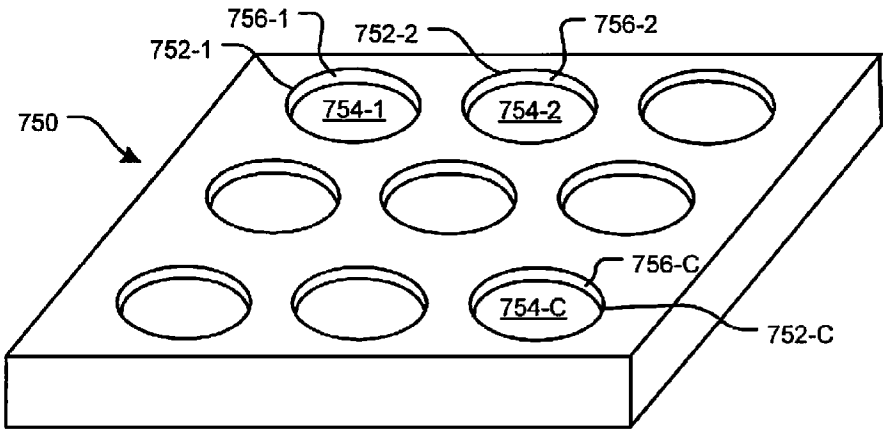
FIG. 24 is a perspective view of a mold for making photoluminescent devices and inserts.

Referring now to FIG. 24, a perspective view of an exemplary mold 750 for making one or more photoluminescent devices and inserts at a time is shown. The mold 750 defines a plurality of mold cavities 752-1, 752-2, . . . , and 752-C (collectively mold cavities 752) each having a corresponding bottom surface 754-1, 754-2, . . . , and 754-C (collectively bottom surfaces 754) and sides 756-1, 756-2, . . . , and 756-C (collectively sides 756). While the mold cavities are shown with a cylindrical shape, the mold cavities 752 may have any suitable shape.

The one or more cast layers of the photoluminescent devices and inserts may be cast in the mold cavities 752. In some implementations, the photoluminescent devices and inserts may be cast upside down in the mold cavities to provide a more uniform outwardly-exposed surface. In other words, the outer surface of the photoluminescent devices and inserts may be cast first, followed by middle layers (if applicable) and then the inner surface. The final cast layer of the photoluminescent devices and inserts may tend to have cupped edges as the resinous layer cures.

Figure 25:
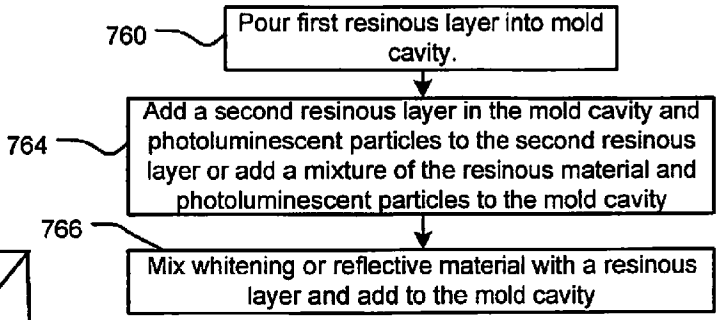
FIG. 25 illustrates an exemplary method for making the photoluminescent devices and inserts of FIG. 24.

Referring now to FIG. 25, an exemplary method for making the photoluminescent devices and inserts of FIG. 24 is shown. In step 760, a first resinous layer is added to the mold cavity. In some implementations, the first resinous layer may correspond to an outwardly-facing surface of the photoluminescent device or insert.

In some implementations, a preceding resinous layer may be allowed to dry or become tacky before a subsequent layer is added. In addition, the mold 750 may be vibrated to enhance mixing of the resinous material with other materials added thereto (if applicable). In other implementations, a vacuum chamber may be used to reduce air bubbles in the cast layers prior to curing.

In step 764, a second resinous layer is poured into the mold cavity and photoluminescent particles may be added to the second resinous layer. Alternately, a mixture of the resinous material and the photoluminescent particles may be added to the mold cavity. In step 766, a reflection-enhancing material may be mixed with a resinous layer and added to the mold cavity in either a single step process (e.g. pre-mixed) or a two-step process (mixed in the cavity). The reflection-enhancing material may comprise pigment, a reflective material, and/or a material with a relatively high index of refraction.

Figure 26:
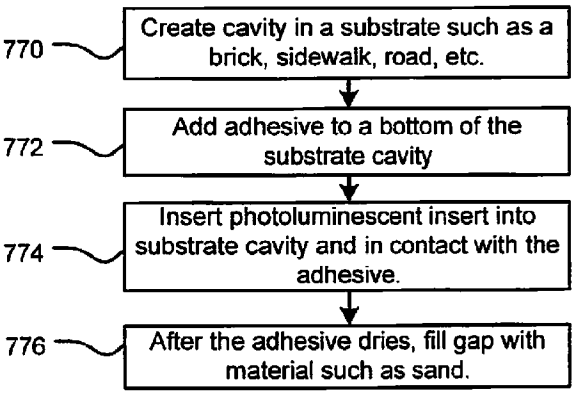
FIG. 26 illustrates an exemplary method for attaching the photoluminescent insert in the cavity of the substrate.

Referring now to FIG. 26, an exemplary method for attaching the photoluminescent insert in the cavity of the substrate is shown. In step 770, a cavity is created in a substrate. The cavity may be made in situ and/or prior to installation.

In step 772, the adhesive is added to a bottom surface of the substrate cavity. In step 774, the photoluminescent insert is inserted into the substrate cavity and in contact with the adhesive.

In some implementations, a gap may be defined between the outer surface of the photoluminescent insert and the cavity. In other implementations, the photoluminescent insert may be arranged immediately adjacent to or abutting inner surfaces of the cavity. When a gap is formed, the gap may be filled with a fill material such as sand in step 776.

Figure 27:
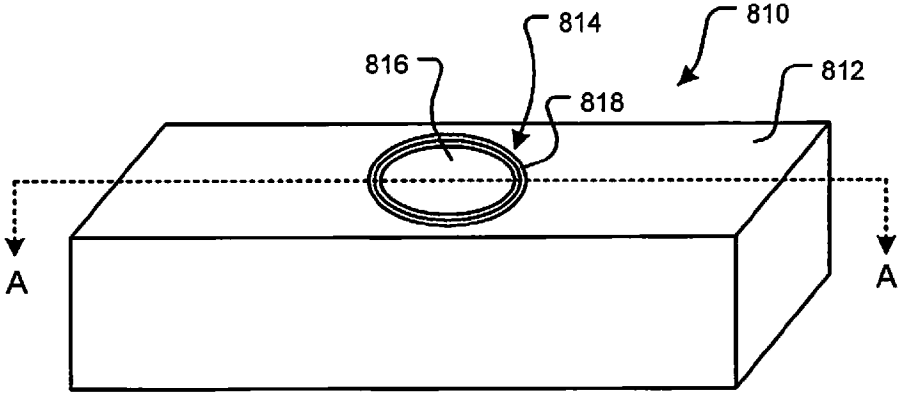
FIG. 27 is a perspective view of a non-powered photoluminescent substrate including a cavity with an alternate photoluminescent insert according to another embodiment.

Referring now to FIG. 27, a perspective view of a non-powered photoluminescent substrate 810 is shown. The paving brick 810 includes a surface 812 including a cavity 814 with a photoluminescent insert 816. Rather than creating the photoluminescent insert in a mold cavity, one or more resinous layers are cast in a member 824 including sides and a bottom surface defining a cavity 834. For example only, the member 824 may be made of plastic and/or may comprise a cap having a circular cross-section or any other suitable shape.

In some implementations, the photoluminescent insert 816 may define a gap 818 between the cavity 814 and an outer edge of the member 824. In other implementations, the photoluminescent insert may be arranged immediately adjacent to or substantially abutting inner surfaces of the cavity 814.

Figure 28:
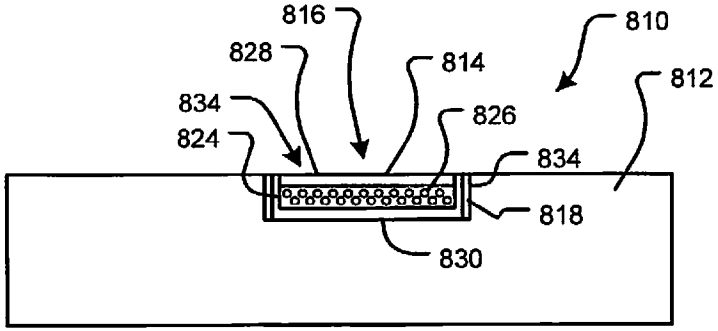
FIG. 28 is a cross-sectional view of the photoluminescent paving brick and the photoluminescent insert of FIG. 27.

Referring now to FIG. 28, a cross-sectional view of the substrate and the photoluminescent insert of FIG. 27 is shown. The photoluminescent insert 816 includes the member 824, a first cast layer 826 and a second cast layer 828. The member 824 includes a bottom surface 830 and sidewalls 832 that extend from the bottom surface 830 to define the cavity 834 for receiving one or more cast layers.

While the member 824 is shown as having a circular cross-section, any other cross sectional shape may be used such as square, triangle rectangle, polygon or other shape. The member 824 may be made of any suitable material. For example only, the member 824 may be made using thermoformed or injection-molded plastic. The material used for the member 824 may be white and/or may be coated on an inner surface thereof with a reflection-enhancing coating.

Figure 29:
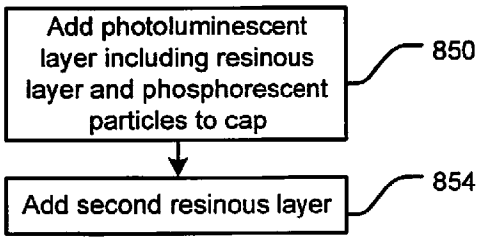
FIG. 29 illustrates an exemplary method for making the photoluminescent insert of FIG. 27.

Referring now to FIG. 29, exemplary methods for making the photoluminescent insert of FIG. 27 is shown. In step 850, a photoluminescent layer including a resinous material and photoluminescent particles are added to the cavity defined by the member. In step 854, a second resinous layer may be added to the cavity of the member.

Figure 30:
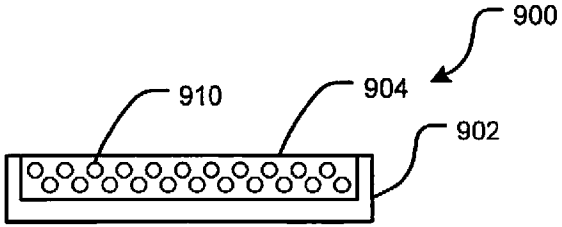
FIG. 30 is a cross sectional view of another alternate photoluminescent insert.

Referring now to FIG. 30, a cross sectional view of another alternate photoluminescent insert 900 is shown. The photoluminescent insert 900 includes a member 902 defining a cavity and a single resinous layer 904 including photoluminescent particles 910.

Figure 31:
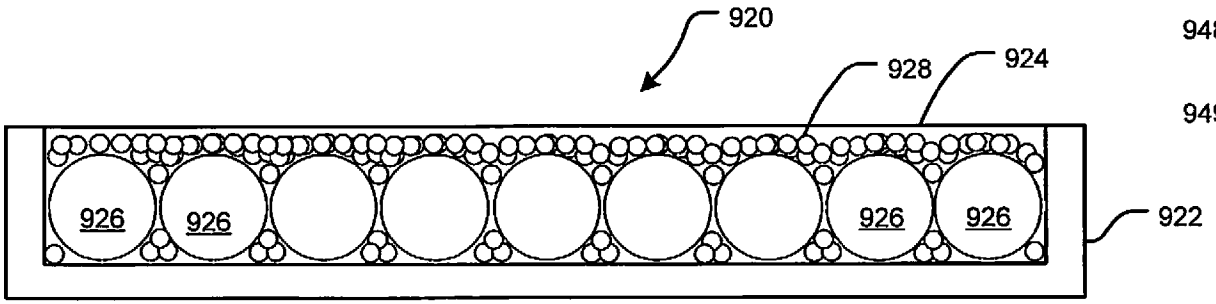
FIG. 31 is a cross sectional view of another alternate photoluminescent insert.

Referring now to FIG. 31, a cross sectional view of an alternate photoluminescent insert 920 is shown. The photoluminescent insert 920 includes a member 922 having sides and a bottom defining a cavity. Resinous material may be added to the cavity of the member 922. Then, light transmitting beads 926 are added on top of the resinous material. The light transmitting beads 926 may be translucent or transparent and may include glass beads, clear plastic beads, etc. Photoluminescent particles 928 are then added to the cap on top of the beads 926. Resinous material is then added. Then, the member is vibrated. Additional resinous material may be added to fill the cap 922.

Figure 32:
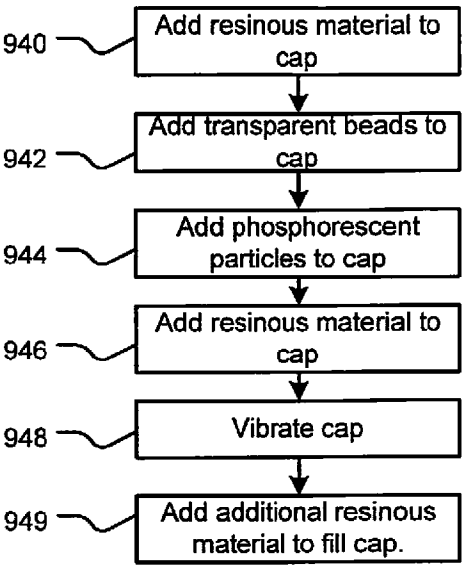
FIG. 32 illustrates an exemplary method for making the photoluminescent insert of FIG. 31.

Referring now to FIG. 32, an exemplary method for making the photoluminescent insert 920 is shown. In step 940, resinous material is added to the cavity of the member 922. In step 942, the beads 926 are added to the cavity of the member 922. In step 944, photoluminescent particles 928 are added to the cavity of the member 922. In step 946, resinous material is added to the cavity of the member 922. In step 948, the member 922 may be vibrated and/or placed in a vacuum chamber. In step 949, additional resinous material may be added to fill the cavity of the member 922.

Figure 33:
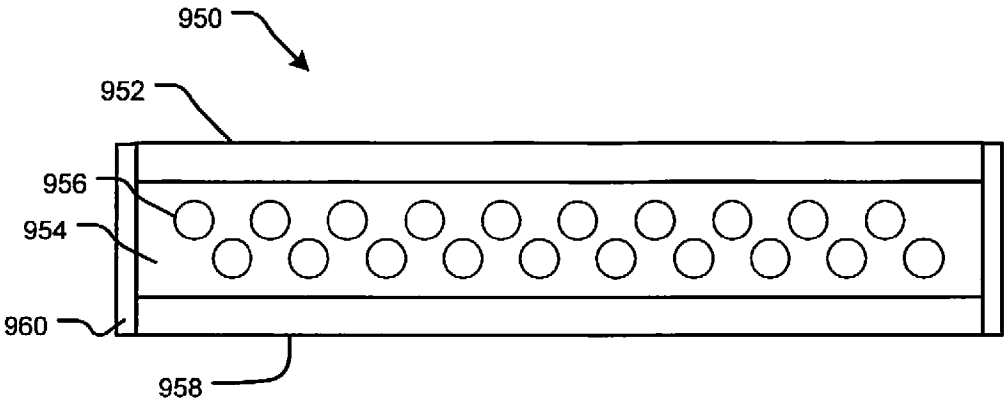
FIG. 33 is a cross sectional view of another alternate photoluminescent insert.

Referring now to FIG. 33, a cross sectional view of another alternate photoluminescent insert 950 is shown. The photoluminescent insert 950 may include a first cast layer 952, a second cast layer 954 and a third cast layer 956. The third cast layer 958 may include a resinous material including a reflection-enhancing material added thereto. For example only, the reflection-enhancing material may comprise a pigment, high index of refraction material or other material. The second cast layer 954 may include a resinous material having photoluminescent particles 956 mixed therein. The first cast layer 952 may comprise the resinous material.

An annular ring or a strip 960 may surround the photoluminescent insert 950 to enhance reflection. For example only, the annular ring or strip may comprise plastic. For example, white plastic may be used. In some implementations, the layers of the photoluminescent insert are cast in a mold with the annular ring or a strip 960.

Figure 34B:
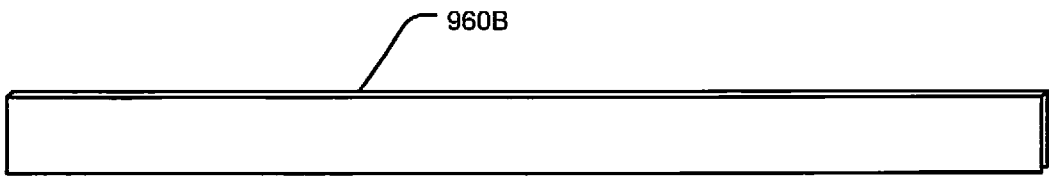
FIG. 34B is a perspective view of a strip that is inserted into the cavity.
Figure 34A:
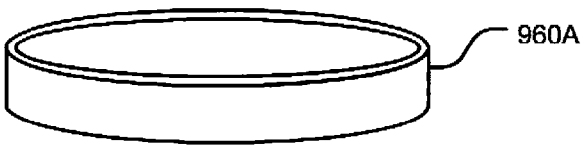
FIG. 34A is a perspective view of an annular ring that is inserted into the cavity.

Referring now to FIG. 34A-34B, perspective views of an annular ring 960A and a strip 960B that may be inserted into the cavity are shown, respectively. The annular ring 960A in FIG. 34A preferably has a diameter approximately equal to a diameter of the mold cavity and a height approximately equal to a depth of the mold cavity. The strip 960B in FIG. 34B preferably has a length approximately equal to a diameter of the mold cavity and a height approximately equal to a depth of the mold cavity.

Figure 35:
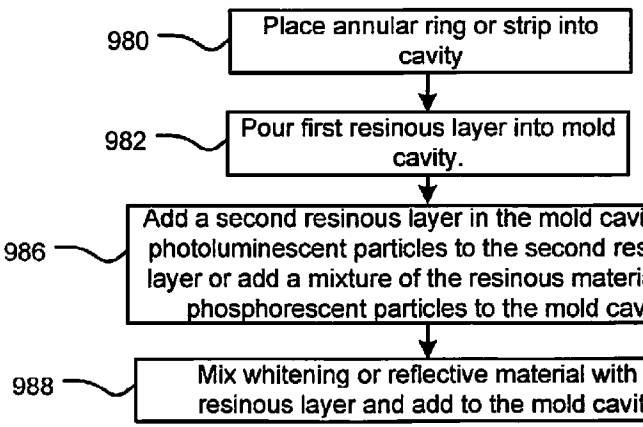
FIG. 35 illustrates an exemplary method for making the photoluminescent insert of FIG. 33.

Referring now to FIG. 35, an exemplary method for making the photoluminescent insert of FIG. 33 is shown. In step 980, the annular ring or strip is placed in the cavity. In step 982, a first resinous layer is poured into the mold cavity. In step 986, a second resinous layer is added to the mold cavity and photoluminescent particles are added to the second resinous layer or a mixture of the resinous material and the photoluminescent particles are added to the mold cavity. In step 988, a reflection-enhancing material is mixed with the resinous layer and added to the mold cavity.

Figure 36:
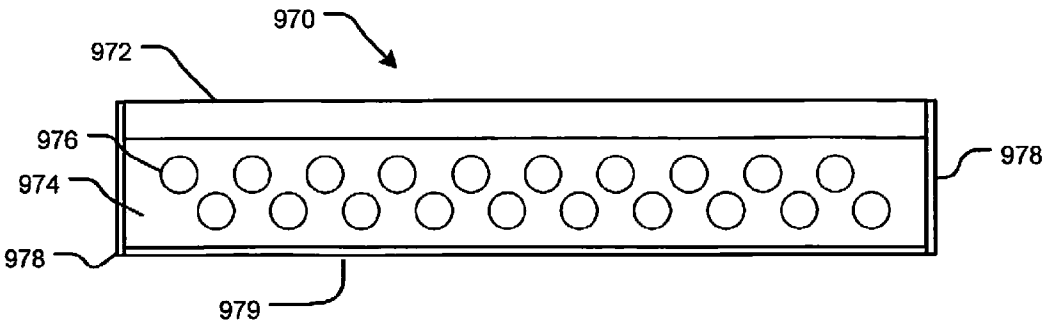
FIG. 36 is a cross sectional view of another alternate photoluminescent insert.

Referring now to FIG. 36, a cross sectional view of another alternate photoluminescent insert 970 is shown. The photoluminescent insert 770 may include a first cast layer 972 and a second cast layer 974. The second cast layer 974 may include a resinous material having photoluminescent particles 976 mixed therein. The first cast layer 972 may comprise the resinous material. Sides 978 and a bottom surface 979 of the photoluminescent insert 970 may be coated with a reflection-enhancing coating. For example, the reflection-enhancing coating may include a white paint. For example, white paint may include titanium dioxide.

Figure 37:
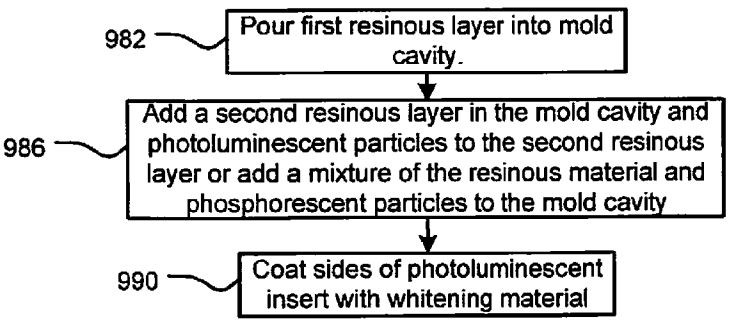
FIG. 37 illustrates an exemplary method for making the photoluminescent insert of FIG. 36.

Referring now to FIG. 37, an exemplary method for making the photoluminescent insert of FIG. 36 is shown. Some of the steps from FIG. 35 are used. Step 980 from FIG. 35 may be omitted. In step 982, a first resinous layer is poured into the mold cavity. In step 986, a second resinous layer is added to the mold cavity and photoluminescent particles are added to the second resinous layer or a mixture of the resinous material and the photoluminescent particles are added to the mold cavity. The photoluminescent material may be removed from the mold after curing. Step 988 from FIG. 35 may be omitted. In step 990, the sides and the bottom surface of the photoluminescent insert may be coated with the reflection-enhancing material.

Figure 38:
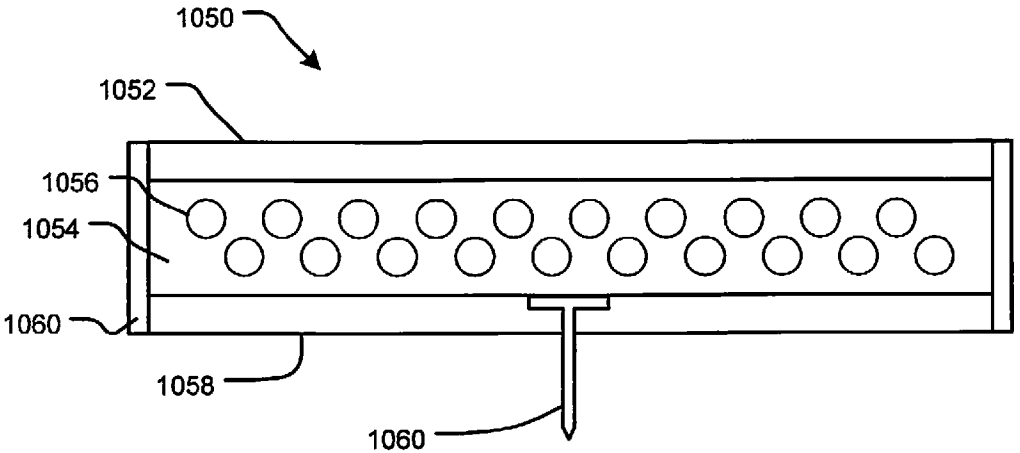
FIG. 38 is a cross sectional view of an alternate photoluminescent insert.

Referring now to FIG. 38, a cross sectional view of an alternate photoluminescent device is shown. The photoluminescent device 1050 may include one or more cast layers. For example only, a first cast layer 1052, a second cast layer 1054 and a third cast layer 1058 are shown. The third cast layer 1058 may include a resinous material including a reflection-enhancing material added thereto. For example only, the third cast layer 1058 may comprise a pigment, a reflective material, and/or a material having a relatively high index of refraction material. The second cast layer 1054 may include a resinous material having photoluminescent particles 1056 mixed therein. The first cast layer 1052 may comprise the resinous material.

An annular ring or a strip 1060 may surround the photoluminescent insert 1050. In some implementations, the layers of the photoluminescent insert are cast in a mold with the annular ring or a strip 1060.

During casting of one or more of the layers, a portion of a fastener 1066 may be positioned in the cavity and a remaining portion may extend outside of the photoluminescent insert after the photoluminescent insert is cured. For example in FIG. 39, the fastener 1066 may be cured in the third cast layer 1058. However, the fastener may also be cured in the first cast layer, the second cast layer, the first and second cast layers, or the first, second and third cast layers. The fastener 1066 may also extend from a top surface, a side surface or a bottom surface of the photoluminescent insert. The fastener 1066 can be used to attach the photoluminescent insert to an object. For example, the photoluminescent insert may be attached to a riser on stairs of a deck.

Figure 39:
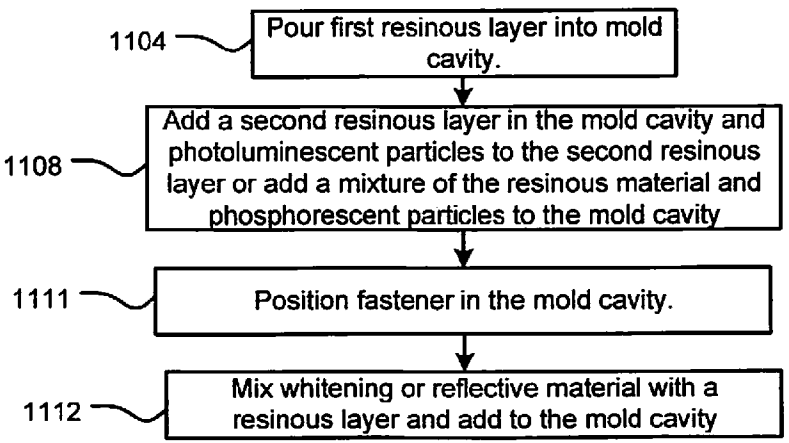
FIG. 39 illustrates an exemplary method for making the photoluminescent insert of FIG. 38.

Referring now to FIG. 39, an exemplary method for making the photoluminescent insert of FIG. 38 is shown. In step 1004, the first resinous layer is added to the mold cavity. In step 1008, the second resinous layer is added to the mold cavity and photoluminescent particles are added to the second resinous layer or a mixture of the resinous material and the photoluminescent particles are added to the mold cavity. In step 1010, the fastener is positioned in the mold cavity. In step 1012, the reflection-enhancing material is mixed with the resinous layer and added to the mold cavity.

While specific features are described in conjunction with one or more specific implementations, skilled artisans will appreciate that each feature may be used in any of the disclosed embodiments.

What is claimed is:

1. A path marking system, comprising:

a substrate defining a substrate cavity;

a photoluminescent insert comprising a first resinous layer that is cast outside of the substrate cavity and that includes photoluminescent particles suspended therein, wherein the photoluminescent particles comprise a phosphorescent material based on Strontium Oxide Aluminate chemistry, and wherein the photoluminescent particles comprise at least one dimension that is greater than or equal to 250 microns;

adhesive for attaching the photoluminescent insert inside of the cavity; and one of:

an annular ring, wherein the first resinous layer is cast in the annular ring and bonds to the annular ring; or an annular strip including first and second ends, wherein the first resinous layer is cast with the annular strip with the first and second ends in an abutting relationship.

2. The path marking system of claim 1 wherein the photoluminescent insert further comprises a second resinous layer that is cast outside of the substrate cavity adjacent to and in contact with a first surface of the first resinous layer.

3. The path marking system of claim 2 further comprising a third resinous layer that is cast outside of the substrate cavity adjacent to and in contact with a second surface of the first resinous layer.

4. The path marking system of claim 2 wherein the second resinous layer comprises a reflection-enhancing material.

5. The path marking system of claim 2 wherein the second resinous layer comprises titanium dioxide.

6. The path marking system of claim 1 wherein the photoluminescent particles comprise at least one dimension that is at least one of:

greater than or equal to 500 microns;

greater than or equal to 700 microns; and greater than or equal to 900 microns.

7. The path marking system of claim 1 wherein the photoluminescent insert is attached in the cavity spaced from an inner edge of the substrate cavity and further comprising fill material arranged in a gap between the inner edge and the photoluminescent insert.

8. The path marking system of claim 1 wherein the first resinous layer further comprises light transmitting beads.

9. The path marking system of claim 1 further comprising a coating applied to at least one of sides of the first resinous layer and an outer surface of the first resinous layer.

10. A path marking system, comprising:

a substrate defining a substrate cavity;

a photoluminescent insert comprising a first resinous layer that is cast outside of the substrate cavity and that includes photoluminescent particles suspended therein, wherein the photoluminescent particles comprise a phosphorescent material based on Strontium Oxide Aluminate chemistry, and wherein the photoluminescent particles comprise at least one dimension that is greater than or equal to 250 microns; and adhesive for attaching the photoluminescent insert inside of the cavity, wherein the photoluminescent insert comprises a member including side walls and a bottom surface that define a cavity, and wherein the first resinous layer is cast in the cavity of the member.

11. A marking device, comprising:

a photoluminescent insert comprising N cast resinous layers, wherein N is an integer greater than or equal to one, wherein a first one of the N cast resinous layers includes photoluminescent particles suspended therein, wherein the photoluminescent particles comprise a phosphorescent material based on Strontium Oxide Aluminate chemistry, and wherein the photoluminescent particles comprise at least one dimension that is greater than or equal to 250 microns; and a fastener including a first portion cast in the photoluminescent insert and a second portion extending outside of the photoluminescent insert.

12. The marking device of claim 11 wherein a second one of the N cast resinous layers is cast adjacent to and in contact with a first surface of the first one of the N cast resinous layers.

13. The marking device of claim 12 wherein a third one of the N cast resinous layers is cast adjacent to and in contact with a second surface of the first one of the N cast resinous layers.

14. The marking device of claim 12 wherein the second one of the N cast resinous layers comprises a reflection-enhancing material.

15. The marking device of claim 14 wherein the second one of the N cast resinous layers comprises titanium dioxide.

16. The marking device of claim 12 wherein the photoluminescent particles comprise at least one dimension that is at least one of:

greater than or equal to 500 microns;

greater than or equal to 700 microns; and greater than or equal to 900 microns.

17. The marking device of claim 11 wherein the first one of the N cast resinous layers comprises light transmitting beads.

18. The marking device of claim 11 further comprising an annular ring, wherein the first one of the N cast resinous layers is cast inside the annular ring and bonds to the annular ring.

19. The marking device of claim 11 further comprising an annular strip including first and second ends, wherein the first one of the N cast resinous layers is cast with the annular strip in a mold with the first and second ends in an abutting relationship.

20. The marking device of claim 11 further comprising a coating applied to at least one of sides of the first one of the N cast resinous layers and an outer surface of the first one of the N cast resinous layers.

21. The marking device of claim 11 wherein the photoluminescent insert comprises a member including side walls and a bottom surface that define a cavity, and wherein the first one of the N cast resinous layers is cast in the member.

* * * * *